United States Patent [19]

Wild

[11] 3,972,143

[45] Aug. 3, 1976

[54] WEAPON FOR TARGET COMPETITION

[75] Inventor: Hermann Wild, Ulm (Danube, Germany

[73] Assignee: J. G. Anschutz GmbH, Ulm (Danube, Germany

[22] Filed: Jan. 29, 1975

[21] Appl. No.: 545,226

[30] Foreign Application Priority Data

Feb. 6, 1974 Germany ..... 7404108

[52] U.S. Cl. ..... 42/75 A

[51] Int. Cl.² ..... F41C 23/00

[58] Field of Search ..... 42/75 A, 75 B, 75 C, 42/71 R; 89/44 R

[56] References Cited

UNITED STATES PATENTS

| | | | |
|---|---|---|---|
| 2,205,982 | 6/1940 | Klipsch | 42/75 A |
| 2,967,368 | 1/1961 | Williams | 42/75 A |
| 3,242,812 | 3/1966 | Maillard | 89/44 R |
| 3,350,807 | 11/1967 | Monroe | 42/75 A |
| 3,783,738 | 1/1974 | Pelat | 89/44 R |

FOREIGN PATENTS OR APPLICATIONS

| | | | |
|---|---|---|---|
| 828,544 | 2/1960 | United Kingdom | 42/75 A |

*Primary Examiner*—Charles T. Jordan

*Attorney, Agent, or Firm*—Holman & Stern

[57] ABSTRACT

A target competition weapon mounting wherein the stock is tensionally connected with the receiver of the weapon is disclosed. The screws of the mounting transmit the tensional force to the stock by means of elastic intermediate elements comprised of cup springs. The cup springs may be alternatively arranged individually in sequence with alternating orientations or arranged in multiple packages of identical orientations which in turn are arranged in alternating sequence.

9 Claims, 3 Drawing Figures

1
2
3
4
5
6
7
8
9
10
11
12
13
14
15

WEAPON FOR TARGET COMPETITION

The present invention concerns a target competition weapon which is provided with a special stock mounting, whereby the stock is tensionally connected with the receiver of the weapon, and the screws of the mounting transmit their tensional force to the stock by means of elastic intermediate elements. In such an embodiment, the intermediate elements prevent, by means of their resilience, complete or partial loss of the initial tension placed on the bolted joint during assembly of the weapon. As is common with screw connections in general, a safety spring washer, a spring-plate or a similar screwing means for each stock fastening-screw is used.

BACKGROUND OF THE INVENTION

In actual practice in spite of using a spring washer, the initial tension force of a joint often rapidly diminishes, and the screws must be tightened again. This is especially true because the stock, in almost all cases, is made of wood or a synthetic material. These materials are unable to constantly withstand high forces of pressure without "creeping." This results in a slight compression of the stock until the screw tension force, which causes the compression, is relieved to the point that no further deformation will occur. A resilient safety washer of the common type is not able to equalize this deformation displacement without stress reduction on the screw and subsequent loosening of the joint.

When wood is used and the compressive force is removed, the deformation slowly is relieved and the stock returns to its original shape and dimensions. This effect appears when the stock is removed from the weapon for some time, for example, when the stock is exchanged for another for a different type of competition.

A further characteristic of the wood and synthetic material used is their tendency to swell with an increase in humidity or to shrink during a decrease.

It is easily noted and is often established in practice that the above-mentioned characteristics of the materials used for stocks, namely, the creeping under load and the swelling and shrinking during variations in humidity, have a substantial affect on the tension of the screwing means. It is therefore necessary to repeatedly re-tighten the fastening screws of the stocks on firing weapons. Additionally, the frequency of the need to re-tighten the stock is higher shortly after the weapon is assembled and decreases with time. A rifleman who regularly exchanges stocks for those of other shapes, because of the advantages during shooting competitions with regard to the types of impact, must constantly check the tension on the screwing means. For this purpose, a screw driver which indicates the rotational momentum, like a torque wrench, is used. After each mounting of a new stock, the force-balance on the screwed joint takes a certain period of time to be established. This is because the deformations, which are lacking at the stress-points of a rarely used stock, must be re-established when the stock is used again.

An expert rifleman will take extreme care that his stocks are fastened to his weapon system always with the required force, since only then will a continuously proper firingfunction of his weapon be guaranteed. Measurements have shown that weapon systems and stocks during the firing of a shot behave like two oscillators which are coupled to each other, thus the rigidity of the screw-joint is important for the proper and consistent total oscillation behaviour.

SUMMARY OF THE INVENTION

The improvement comprises elastic intermediate elements which are constructed on screw-joints for stocks in such a manner that the initial tension placed on the joint without any further assistance will only slightly or not at all decrease over a prolonged time period.

This problem is inventively solved in that the elastic intermediate elements, each comprising a multitude of cup springs, form a spring assembly. The individual cup springs may be interchangeably placed in series, whereby the spring assembly has a relatively large equivalent spring pitch. The same cup springs may be assembled with each spring identically oriented into a plurality of equally high tension spring packages, and these may reciprocally be placed in series. This will increase the rigidity of the spring system. However, the use of several cup springs as a unit will reduce the possible equivalent spring pitch.

It is suitable to guide the spring assembly and the screw with a structural part that has a stepped bore which transmits the spring force to the parts which are to be spanned. A flanged bushing which is insertable into the stock, is especially suitable for this purpose. The screw means can be used for fastening the trigger guard. For this purpose, a pressure plate, being adapted to the outer contour of the trigger guard and being provided with a stepped bore, is placed onto the clamping end of the trigger guard.

When the stocks are to be changed frequently, it is recommended that a spring stop in the form of a protrusion be provided at a suitable point on the screw shaft in order to undetachably connect the cup springs with the screw means. However, if a screw is used which has a threaded portion produced by rolling, the cup springs can be placed on the screw shaft before it is threaded. Afterwards, because of the expansion of the shaft from this operation, they can no longer be pulled off.

The advantages obtained by means of the present invention consists especially in that the spring assembly is able to transmit and maintain higher tension forces and adapt to changes in the thickness of the mutually spanned parts, while keeping the tension forces fully balanced. The spring rigidity may be chosen so that the thickness-changes will cause only slight forcechanges, which is an important factor for the firing-precision of a weapon.

BRIEF DESCRIPTION OF THE DRAWINGS

One embodiment of the instant invention is illustrated in the drawing and described in detail hereinbelow, wherein.

DETAILED DESCRIPTION OF A PREFERRED EMBODIMENT

Figures 1, 2, 3:
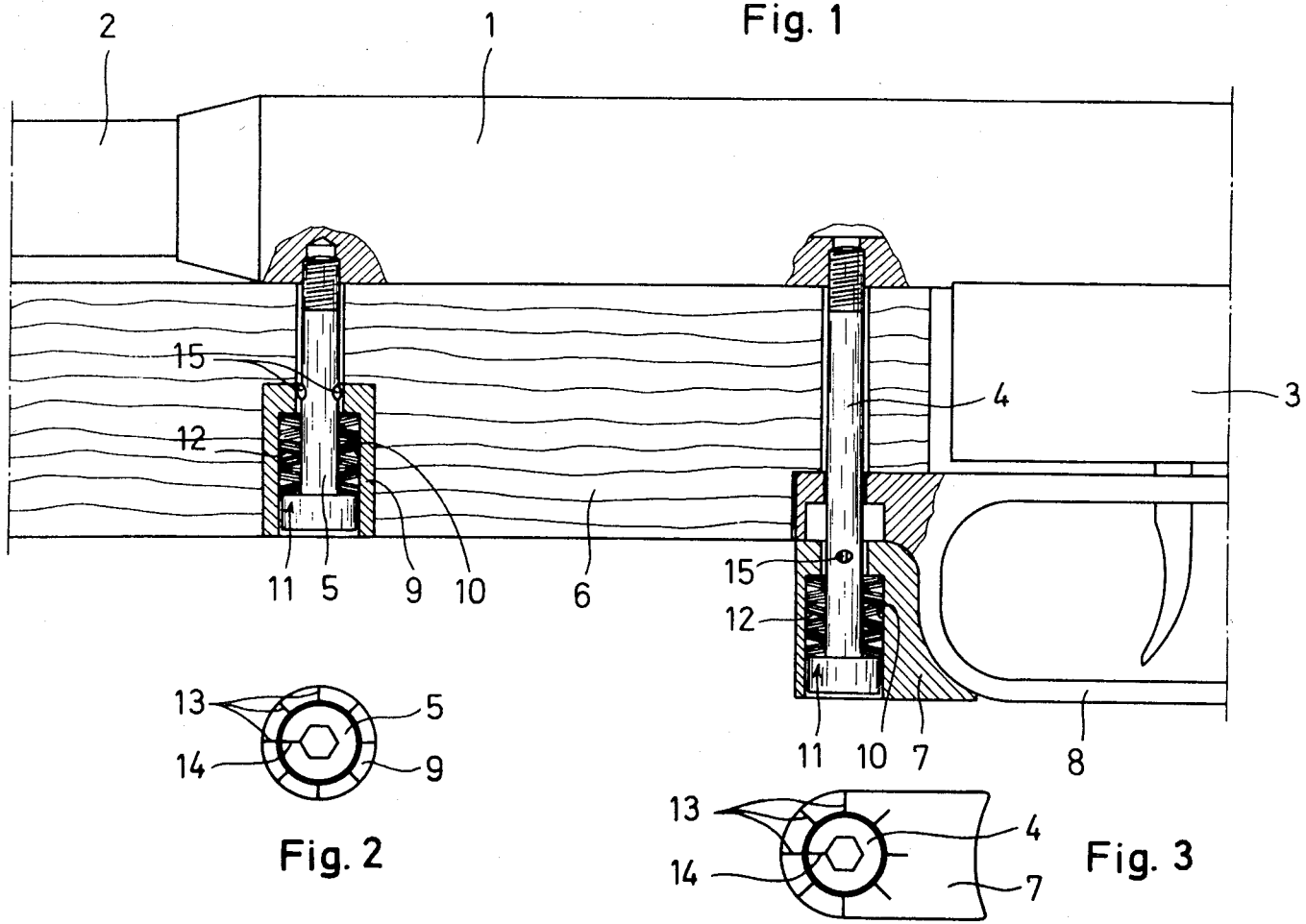
FIG. 1 shows a partial cross-section view of a rifle.
FIG. 2 shows a bottom view of a screw head with flanged bushing.
FIG. 3 shows a bottom view of a screw head mounted in a pressure plate.

In the receiver 1 of a weapon are mounted a barrel 2 and a trigger mechanism 3. Two cylinder screws 4 and 5 are screwed into the receiver 1, and are fastening thereon a wooden stock 6. Furthermore, a trigger guard 8 is clamped onto the stock 6 by means of the cylinder screw 4 and a pressure plate 7. The pressure plate 7 has the same width as the trigger guard 8 and is adapted to the outer contour of the latter. The cylinder screw 5 is partially enclosed by a flanged bushing 9 which is inserted in the stock 6.

The pressure plate 7 and the flanged bushing 9 are each provided with a stepped bore 10, in which is located a spring assembly 11 which comprises a plurality of individual cup springs 12. Three cup springs 12 are identically oriented and nested into one spring package. Six of such spring packages are in contiguous arrangement and so form the spring assembly 11. The spring assembly 11 supports itself with one of its ends on the annular area of the stepped bore 10 and with its other end on the head of the cylinder screw 4 or 5. The length of the stepped bore 10 is adapted to the length of the spring assembly 11 in a manner so that at the required initial tension, which is obtained with the cylinder screw 4 or 5, the screw head is completely contained in the stepped bore, and is seated slightly below the surface parallel to the plane of the outer surface of bushing 9. This parallel plane surface of the pressure plate 7 and the flange bushing 9 is provided with eight section lines 13 which are evenly arranged in the circle, and the screw head is provided with an index line 14 (FIGS. 2 and 3). The setting of a predetermined initial tension stress is simplified with these line-markings when no torque wrench is available.

At opposite sides of the screw shaft, there are located spring stops 15 in the form of protrusions, having a distance from the screw head which is large enough that the tension on the spring assembly 11 can be completely relieved when the cylinder screw 4 or 5 is screwed out of the receiver 1. The spring stops 15 will prevent the spring assembly 11 from leaving the cylinder screw when the screw is removed from the mounting.

What is claimed is:

1. A target competition firearm mounting wherein a stock is tensionally connected with a receiver by means of screws, which transmit their tensional forces by means of one spring assembly system each to said stock, each said spring assembly comprising a plurality of cup springs and being arranged in a flanged bushing inserted into said stock, said flanged bushing having circularly arranged section lines on its outer front surface and said screw having a radial index line on its head.

2. The target competition firearm mounting according to claim 1 wherein each of said screws is provided with at least one spring stop in the form of a protrusion.

3. The target competition firearm mounting according to claim 2 wherein the individual cup springs are arranged with alternating orientation.

4. The target competition firearm mounting according to claim 2 wherein the individual cup springs are assembled together to form a plurality of equally high tension spring packages comprising a number of cup springs identically oriented and arranged immediately adjacent to each other and said high tension spring packages are alternately arranged in series.

5. A target competition firearm mounting wherein a stock is tensionally connected with a receiver and a trigger guard by means of screws, which transmit their tensional forces by means of one spring assembly system each to said stock, each said spring assembly comprising a plurality of cup springs and being arranged in a pressure plate provided with a stepped bore, said pressure plate being adapted to the outer contour of said trigger guard and holding said trigger guard in place.

6. The target competition firearm mounting according to claim 5, wherein said pressure plate had circularly arranged section lines surrounding said stepped bore on said outer front surface and said screw has a radial index line on its head.

7. The target competition firearm mounting according to claim 6, wherein each of said screws is provided with at least one spring stop in the form of a protrusion.

8. The target competition firearm mounting according to claim 7 wherein the individual cup springs are arranged with alternating orientation.

9. The target competition firearm mounting according to claim 7 wherein the individual cup springs are assembled together to form a plurality of equally high tension spring packages comprising a number of cup springs identically oriented and arranged immediately adjacent to each other and said high tension spring packages are alternately arranged in series.

* * * * *